US008394450B2

(12) United States Patent
Baba et al.

(10) Patent No.: US 8,394,450 B2
(45) Date of Patent: Mar. 12, 2013

(54) PROCESS FOR PRODUCING MAGNET

(75) Inventors: Fumitaka Baba, Tokyo (JP); Hideki Nakamura, Tokyo (JP); Satoshi Tanaka, Tokyo (JP); Takeshi Masuda, Tokyo (JP)

(73) Assignee: TDK Corporation, Chuo-ku, Tokyo (JP)

( * ) Notice: Subject to any disclaimer, the term of this patent is extended or adjusted under 35 U.S.C. 154(b) by 288 days.

(21) Appl. No.: 12/473,429

(22) Filed: May 28, 2009

(65) Prior Publication Data

US 2009/0297699 A1 Dec. 3, 2009

(30) Foreign Application Priority Data

May 29, 2008 (JP) ..... P2008-141208

(51) Int. Cl.
*B05D 7/14* (2006.01)

(52) U.S. Cl. ..... 427/131; 427/130; 428/694 RE

(58) Field of Classification Search ..... 427/130; 428/694 ML, 694 RE, FOR. 137, 822.3, 822.4, 428/822.5
See application file for complete search history.

(56) References Cited

U.S. PATENT DOCUMENTS

| | | | | |
|---|---|---|---|---|
| 5,676,998 | A * | 10/1997 | Araki et al. | 427/132 |
| 2008/0092994 | A1 | 4/2008 | Satsu et al. | |
| 2008/0245442 | A1 * | 10/2008 | Nakamura et al. | 148/101 |
| 2009/0020193 | A1 * | 1/2009 | Ohta et al. | 148/559 |

FOREIGN PATENT DOCUMENTS

| | | | |
|---|---|---|---|
| CN | 101006534 | | 7/2007 |
| JP | 2005-011973 | * | 1/2005 |
| JP | 2005-209932 | | 8/2005 |
| JP | 2005-285860 | | 10/2005 |
| JP | 2005-285861 | | 10/2005 |
| WO | WO 2006/043348 | | 4/2006 |
| WO | WO/2006/043348 | * | 4/2006 |
| WO | WO 2006/112403 A1 | | 10/2006 |

* cited by examiner

*Primary Examiner* — Michael Cleveland
*Assistant Examiner* — Tabassom Tadayyon Eslami
(74) *Attorney, Agent, or Firm* — Drinker Biddle & Reath LLP

(57) ABSTRACT

The process for producing a magnet according to the invention is characterized by comprising a first step in which a heavy rare earth compound containing Dy or Tb as a heavy rare earth element is adhered onto a sintered compact of a rare earth magnet and a second step in which the heavy rare earth compound-adhered sintered compact is subjected to heat treatment, wherein the heavy rare earth compound is a Dy or Tb iron compound.

2 Claims, 1 Drawing Sheet

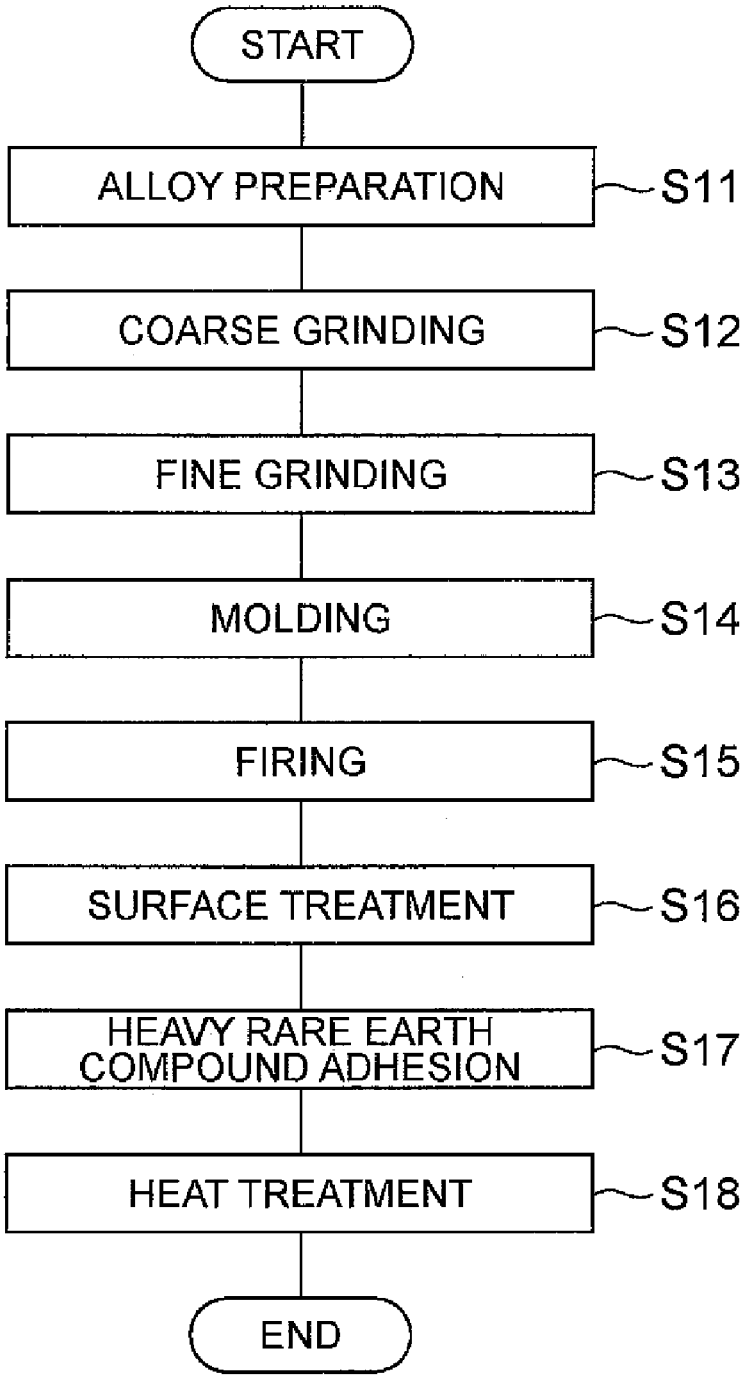
START
ALLOY PREPARATION
S11
COARSE GRINDING
S12
FINE GRINDING
S13
MOLDING
S14
FIRING
S15
SURFACE TREATMENT
S16
HEAVY RARE EARTH COMPOUND ADHESION
S17
HEAT TREATMENT
S18
END

PROCESS FOR PRODUCING MAGNET

BACKGROUND OF THE INVENTION

1. Field of the Invention

The present invention relates to a process for producing a magnet, and more specifically it relates to a process for producing a rare earth magnet containing a rare earth element.

2. Related Background Art

Rare earth magnets with R—Fe—B (=rare earth element) based compositions exhibit excellent magnetic properties, and much research is being devoted to further improving their magnetic properties. Residual flux density (Br) and coercive force (HcJ) are generally used as indices of the magnetic properties of magnets. It is known in the art that the HcJ value of a rare earth magnet can be improved by adding Dy or Tb.

However, since the saturation magnetization of an R—Fe—B based compound is lowered when an element such as Dy or Tb is selected as R, its addition in an excessive amount will tend to reduce the Br value. A method for minimizing this inconvenience has been disclosed in International Patent Publication No. WO2006/043348, wherein a sintered magnet having an R—Fe—B based composition is subjected to heat treatment at a temperature below its sintering temperature while a powder containing an oxide, fluoride or oxyfluoride of a rare earth element is present on its surface. Also, Japanese Patent Application Laid-open No. 2005-285860, Japanese Patent Application Laid-open No. 2005-285861 and Japanese Patent Application Laid-open No. 2005-209932 disclose processes for producing rare earth magnets by dipping a magnet element in a molten alloy composed mainly of a rare earth element.

SUMMARY OF THE INVENTION

Although high rare earth magnets with high magnetic properties can be obtained by such prior art production processes, high heat treatment temperatures of above 1000° C. have been necessary to maintain stable magnetic properties. Moreover, the processes described in Japanese Patent Application Laid-open No. 2005-285860, Japanese Patent Application Laid-open No. 2005-285861 and Japanese Patent Application Laid-open No. 2005-209932 have required special production equipment due to their use of molten alloys, and this has tended to complicate the conditions for production. In addition, when heat treatment is carried out at high temperatures of above 1000° C. there is a greater influence by temperature variation during the heat treatment, and due to potential grain growth and excess diffusion of the elements by the heat treatment, it is difficult to produce a magnet with stabilized magnetic properties at a high yield.

It is therefore desirable to produce a rare earth magnet that maintains a sufficiently high Br and has further increased HcJ, even at relatively low heat treatment temperatures.

It is an object of the present invention, which has been accomplished in light of these circumstances, to provide a process for producing a magnet that can yield a magnet with a sufficiently high Br and excellent HcJ even at relatively low heat treatment temperatures.

As a result of much diligent research by the present inventors aimed at achieving the object stated above, it has been discovered that adhering a compound of a specific rare earth element to a sintered compact provides sufficiently high Br and excellent HcJ even at relatively low heat treatment temperatures, and the present invention has been completed on the basis of this discovery.

Specifically, the process for producing a magnet according to the invention is characterized by comprising a first step in which a heavy rare earth compound containing Dy or Tb as a heavy rare earth element is adhered onto a sintered compact of a rare earth magnet, and a second step in which the heavy rare earth compound-adhered sintered compact is subjected to heat treatment, wherein the heavy rare earth compound is a iron compound of Dy or a iron compound of Tb. The term "sintered compact of rare earth magnet" refers to a sintered compact obtained by firing the starting material (magnetic powder or the like) that is used to form the rare earth magnet.

It is conjectured, though not absolutely determined, that adhering an iron compound of a specific heavy rare earth element to the sintered compact of the rare earth magnet and subjecting it to heat treatment according to the process for producing a magnet according to the invention, causes the heavy rare earth element to be selectively incorporated into the fringe regions and grain boundaries of the main phase particles composing the sintered compact. This is presumed to be the reason for the excellent HcJ of the magnet that is obtained by using the heavy rare earth element, while the adequately high Br is attributed to the fact that the heavy rare earth element is not present in excess in the main phase particles.

According to the invention, a Dy or Tb iron compound particularly with the Dy or Tb content in a specified range is used as the heavy rare earth compound, thus widening the range in which flux can be maintained against a demagnetizing field, and allowing the HcJ to be significantly increased. Since a Dy or Tb iron compound aggregates more readily to build up more deposit than a fluoride compound, its coercive force-increasing effect is particularly excellent. Also, Dy or Tb iron compounds have low melting points near the eutectic point, thus allowing the heat treatment temperature to be reduced and minimizing the effects of temperature variation during heat treatment. Using a Dy or Tb iron compound, therefore, can yield a magnet with sufficient Br and excellent HcJ.

Moreover, since the Dy or Tb iron compound used according to the invention is a constituent component of the magnet, unlike a fluoride compound, fewer impurities are left after heat treatment and it is easier to obtain a magnet with minimal deterioration of properties due to such impurities, compared to using a fluoride compound as according to the prior art. A magnet obtained according to the invention exhibits sufficient Br and excellent HcJ as a consequence of these factors.

In the first step of the process for producing a magnet according to the invention, the sintered compact is preferably coated with a slurry comprising the heavy rare earth compound dispersed in a solvent, in order to adhere the heavy rare earth compound onto the sintered compact. Coating a slurry onto the sintered compact allows the heavy rare earth compound to be uniformly adhered onto the sintered compact. As a result, the heavy rare earth compound becomes evenly diffused by the heat treatment, allowing more satisfactory improvement in properties to be achieved.

The mean particle size of the heavy rare earth compound adhered onto the sintered compact is preferably 100 nm-50 μm. This will allow even more satisfactory diffusion of the heavy rare earth compound to be achieved by the heat treatment.

According to the invention it is possible to provide a process for producing a magnet that can yield a magnet with sufficiently high Br and excellent HcJ even at relatively low heat treatment temperatures.

BRIEF DESCRIPTION OF THE DRAWINGS

FIG. 1 is a flow chart showing the production steps for a rare earth magnet according to a preferred embodiment.

DESCRIPTION OF THE PREFERRED EMBODIMENTS

Preferred modes of the invention will now be explained.

FIG. 1 is a flow chart showing the production steps for a magnet (rare earth magnet) according to a preferred embodiment.

For production of a rare earth magnet according to this embodiment, first an alloy is prepared that will yield a rare earth magnet having the desired composition (step S11). In this step, for example, a simple substance, alloy or compound, which contains elements including the metals corresponding to the composition of the rare earth magnet, is melted under a vacuum or an inert gas atmosphere such as argon, and then the molten substance is used for an alloy production process such as casting or strip casting to produce an alloy having the desired composition.

The alloy may be a combination of two types, namely an alloy having the composition for the main phase of the rare earth magnet (main phase alloy) and an alloy having the composition for the grain boundary phase (grain boundary phase alloy).

The rare earth magnet used for the invention may be one composed mainly of Nd or Pr as the rare earth element, and is preferably one having a composition comprising a combination of a rare earth element with a transition element other than the rare earth element. Specifically, it is preferably one having an R—Fe—B based composition that includes at least one among Nd, Pr, Dy and Tb as the rare earth element (represented by "R") at 25-35 wt % and that contains B as an essential element at 0.5-2.0 wt %, with the remainder Fe. If necessary, the rare earth magnet may also have a composition that further contains other elements such as Co, Ni, Mn, Al, Cu, Nb, Zr, Ti, W, Mo, V, Ga, Zn and Si.

The obtained alloy is then subjected to coarse grinding to produce particles with particle sizes of about several hundred pim (step S12). The coarse grinding of the alloy may be carried out using a coarse grinding machine such as a jaw crusher, Braun mill or stamp mill, or by absorbing the hydrogen in the alloy and then causing self-destructive grinding based on the difference in absorbed hydrogen amounts between the different phases (hydrogen absorption grinding).

Next, the powder obtained by the coarse grinding is further subjected to fine grinding (step S13) to obtain a starting powder for the rare earth magnet having a particle size of preferably about 1-10 μm and more preferably 3-5 μm (hereinafter also referred to simply as "starting powder"). The fine grinding may be carried out by subjecting the coarsely ground powder to further grinding using a fine grinding machine such as a jet mill, ball mill, vibrating mill or wet attritor, while appropriately adjusting the conditions such as the grinding time.

When two different types of alloys, a main phase alloy and a grain boundary phase alloy, are prepared for production of the alloy, the coarse grinding and fine grinding may be carried out on both alloys and the two fine powders obtained thereby combined to prepare the starting powder.

The starting powder obtained in this manner is then molded into the desired shape (step S14). The molding is conducted in the presence of an applied magnetic field which produces a prescribed orientation in the starting powder. The molding may be press molding, for example. Specifically, after the starting powder has been packed into a die cavity, the packed powder is pressed between an upper punch and a lower punch to mold the starting powder into the prescribed shape. There are no particular restrictions on the shape of the compact obtained by molding, and it may be changed to a cylindrical, planar, ring or other shape, according to the intended shape of the rare earth magnet. The pressing during molding is preferably at 0.5-1.4 ton/cm$^2$. The applied magnetic field is preferably 12-20 kOe. The molding method may be dry molding wherein the starting powder is molded directly as described above, or wet molding wherein a slurry of the starting powder dispersed in a solvent such as an oil is molded.

Next, the compact is fired by heating at 1010-1110° C. for 2-6 hours in a vacuum or in the presence of an inert gas, for example (step S15). This causes the starting powder to undergo liquid phase sintering, to obtain a sintered compact with an improved volume ratio of the main phase (a sintered rare earth magnet).

After being worked into the appropriate and desired size and shape, the surface of the sintered compact is preferably treated with an acid solution (step S16). The acid solution used for the surface treatment is preferably a mixture of an alcohol with an aqueous solution of nitric acid, hydrochloric acid or the like. The surface treatment may also be carried out by immersing the sintered compact in the acid solution or spraying the sintered compact with the acid solution.

The surface treatment removes the dirt or oxide layer attached to the sintered compact to yield a clean surface, and is therefore advantageous for the heavy rare earth compound adhesion and diffusion described hereunder. From the viewpoint of achieving more satisfactory removal of the dirt or oxide layer, the surface treatment may be carried out with application of ultrasonic waves to the acid solution.

Next, the heavy rare earth compound containing the heavy rare earth element is adhered onto the surface of the surface treated sintered compact (step S17). The term "heavy rare earth element" refers to rare earth elements with high atomic numbers, and generally includes the rare earth elements from $_{64}$Gd to $_{71}$Lu. The heavy rare earth element in the heavy rare earth compound for this embodiment is Dy or Tb. According to this embodiment, only iron compounds of the heavy rare earth elements are used as heavy rare earth compounds, whereas heavy rare earth element compounds other than iron compounds, such as oxides, halides or hydroxides, are not used. As specific heavy rare earth compounds there may be mentioned DyFe, TbFe, DyFeH and TbFeH. The heavy rare earth compound according to the invention is an alloy of iron with Dy or Tb, and it does not have the excellent high magnetic properties of ordinary magnets. The Dy or Tb content in the heavy rare earth compound is preferably 60-95 wt %. When the heavy rare earth compound is DyFe or TbFe, the Dy or Tb content is more preferably 65-95 wt % and even more preferably 70-92 wt %. When the heavy rare earth compound is DyFeH or TbFeH, the Dy or Tb content is more preferably 64-94 wt % and even more preferably 69-91 wt %. A portion of the Fe in the heavy rare earth compound may be replaced with Co, Al or Cu, in a range such that the effect of the invention is still exhibited.

The heavy rare earth compound adhered onto the sintered compact is preferably in granular form, with a mean particle size of preferably 100 nm-50 μm and more preferably 1 μm-10 μm. If the particle size of the heavy rare earth compound is less than 100 nm, the amount of heavy rare earth compound diffused in the sintered compact by the heat treatment will be excessive, potentially resulting in insufficient Br in the obtained rare earth magnet. If it is greater than 50 μm, on the other hand, the heavy rare earth compound will not diffuse easily in the sintered compact, and the HcJ may not be sufficiently improved.

The method of adhering the heavy rare earth compound onto the sintered compact may be, for example, a method in which particles of the heavy rare earth compound are directly blasted onto the sintered compact, a method in which a solution of the heavy rare earth compound in a solvent is applied onto the sintered compact, or a method in which a slurry of the heavy rare earth compound particles dispersed in a solvent is applied onto the sintered compact. Of these, the method of applying a slurry onto the sintered compact is preferred since it allows the heavy rare earth compound to be more evenly adhered onto the sintered compact and results in satisfactory diffusion in the heat treatment described hereunder.

The solvent used for the slurry is preferably an alcohol, aldehyde, ketone or the like that can evenly disperse the heavy rare earth compound without dissolving it, and ethanol is preferred. Application of the slurry onto the sintered compact may be accomplished by dipping the sintered compact into the slurry, or by dropping the slurry onto the sintered compact.

When a slurry is used, the content of the heavy rare earth compound in the slurry is preferably 5-50 wt % and more preferably 5-30 wt %. If the content of the heavy rare earth compound in the slurry is too low or too high, it may be difficult to achieve uniform adhesion of the heavy rare earth compound onto the sintered compact, potentially making it impossible to obtain a sufficient squareness ratio. If it is too high, the surface of the sintered compact may be roughened and it may be difficult to form a plating for improved corrosion resistance of the obtained magnet.

Components other than heavy rare earth compounds may also be included in the slurry if necessary. As examples of other components to be included in the slurry there may be mentioned dispersing agents to prevent aggregation of the heavy rare earth compound particles.

The heavy rare earth compound-adhered sintered compact is then subjected to heat treatment (step S18). This will allow the heavy rare earth compound adhered on the surface of the sintered compact to diffuse into the sintered compact. The heat treatment may be carried out in a two-stage step, for example. In this case, heat treatment is preferably carried out for 10 minutes-10 hours at about 800-1000° C. in the first stage, and then for 1-4 hours at about 500-600° C. in the second stage. In this two-stage heat treatment, diffusion of the heavy rare earth compound is mainly produced in the first stage, while the heat treatment in the second stage serves as "aging treatment" to help improve the magnetic properties (especially HcJ). However, the heat treatment does not necessarily need to be carried out in two stages and will be sufficient if it at least causes diffusion of the heavy rare earth compound.

Although the heat treatment causes diffusion of the heavy rare earth compound from the surface to the interior of the sintered compact, it is believed that the heavy rare earth compound diffuses primarily along the boundaries of the main phase particles composing the sintered compact. As a result, the heavy rare earth element of the heavy rare earth compound in the obtained magnet becomes maldistributed at the fringe regions or grain boundaries of the main phase particles, thus forming a structure wherein the main phase particles are covered by a layer of the heavy rare earth element.

Next, the heavy rare earth compound-diffused sintered compact is cut to the desired size and subjected to surface treatment, as necessary, to obtain the rare earth magnet. The obtained rare earth magnet may also be provided with a protective layer on its surface to prevent deterioration, such as a plating layer, oxidation layer or resin layer.

In the process for producing a rare earth magnet according to this embodiment as explained above, adhesion and heat treatment of the heavy rare earth compound are carried out after forming the sintered compact, thus allowing the heavy rare earth element to selectively diffuse primarily at the fringe regions and grain boundaries of the main phase particles composing the magnet, and thereby improving the HcJ while maintaining an adequate Br value. Also, since an iron compound is used as the heavy rare earth compound according to this embodiment and the heat treatment temperature can be relatively reduced as a result, the effects of temperature variation in the furnace during magnet production are minimized and grain growth or excessive element diffusion can be inhibited, thus allowing a rare earth magnet with excellent magnetic properties to be obtained in an efficient manner.

The present invention is not in any way limited to the preferred mode described above.

EXAMPLES

The present invention will now be explained in detail by examples, with the understanding that the invention is not limited to the examples.

[Production of Rare Earth Magnets]

Example 1

First, a starting alloy was prepared to produce a rare earth magnet having the composition 23.50 wt % Nd-3.50 wt % Dy-3.30 wt % Pr-0.450 wt % Co-0.18 wt % Al-0.06 wt % Cu-0.97 wt % B-bal.Fe. Two starting alloys were prepared, a main phase alloy primarily for formation of the main phase of the magnet, and a grain boundary alloy primarily for formation of the grain boundary. Next, the starting alloys were subjected to coarse grinding by hydrogen grinding and then jet mill grinding with high pressure $N_2$ gas to produce fine powders each with mean particle sizes of D=4 μm.

The fine powder for the main phase alloy and the fine powder for the grain boundary alloy were mixed in a proportion of 95:5, respectively, to prepare a magnetic powder as the starting powder for the rare earth magnet. The magnetic powder was then used for magnetic field molding under conditions with a molding pressure of 1.2 t/cm$^2$ and an orienting magnetic field of 15 kOe, to obtain a compact. The obtained compact was fired under conditions of 1060° C., 4 hours to obtain a sintered compact of the rare earth magnet having the composition mentioned above.

The obtained sintered compact was immersed for 3 minutes in a 3 wt % nitric acid/ethanol mixed solution and then treated twice by immersion in ethanol for 1 minute for surface treatment of the sintered compact. All of these treatments were carried out with application of ultrasonic waves. Next, the surface-treated sintered compact was immersed in a slurry comprising DyFe (mean particle size D=5 μm) dispersed in ethanol (DyFe content=50 wt %) while applying ultrasonic waves, and then the slurry-adhered sintered compact was dried under a nitrogen atmosphere. This caused the DyFe to adhere onto the surface of each sintered compact.

The DyFe powder used had the composition shown in Table 1, and was prepared by coarsely grinding the DyFe alloy with a Braun mill and then pulverizing it with a ball mill for 72 hours.

The dried sintered compact was subjected to heat treatment at 900° C. or at 1000° C. for 1 hour and then to aging treatment at 540° C. for 1 hour to obtain a rare earth magnet. The size of the obtained rare earth magnet was 2.5 mm (thickness in the magnetic anisotropy direction)×14 mm×10 mm.

Examples 2-6

Rare earth magnets were produced in the same manner as Example 1, except that the DyFe composition was changed to the compositions shown in Table 1.

Example 7

A rare earth magnet was produced in the same manner as Example 1, except that DyNdFe having the composition shown in Table 1 was used instead of DyFe.

Examples 8-13

Rare earth magnets were produced in the same manner as Example 1, except that DyFeH having the composition shown in Table 1 was used instead of DyFe.

The DyFeH powder used was produced by heating DyFe alloy at 350° C. for 1 hour under a hydrogen atmosphere for absorption, and then treating it at 600° C. for 1 hour under an Ar atmosphere and subsequently pulverizing with a ball mill for 72 hours.

Example 14

A rare earth magnet was produced in the same manner as Example 1, except that DyNdFeH having the composition shown in Table 1 was used instead of DyFe.

The DyNdFeH powder used was produced by heating DyNdFe alloy at 350° C. for 1 hour under a hydrogen atmosphere for absorption, and then treating it at 600° C. for 1 hour under an Ar atmosphere and subsequently pulverizing with a ball mill for 72 hours.

Examples 15 and 16

Rare earth magnets were produced in the same manner as Example 1, except that TbFe having the composition shown in Table 1 was used instead of DyFe.

Comparative Example 1

A rare earth magnet was produced in the same manner as Example 1, except that $DyF_3$ was used instead of DyFe.

Comparative Example 2

After obtaining a sintered compact for a rare earth magnet in the same manner as Example 1, it was subjected to heat treatment at 900° C. for 1 hour and then to aging treatment at 540° C. for 1 hour to obtain a rare earth magnet.

TABLE 1

| | Rare earth element compound composition (wt %) | | | | |
|---|---|---|---|---|---|
| | Dy | Tb | Fe | H | Nd |
| Example 1 | 95.0 | — | 5.0 | — | — |
| Example 2 | 88.0 | — | 12.0 | — | — |
| Example 3 | 80.0 | — | 20.0 | — | — |
| Example 4 | 60.0 | — | 40.0 | — | — |
| Example 5 | 45.0 | — | 55.0 | — | — |
| Example 6 | 34.0 | — | 66.0 | — | — |

TABLE 1-continued

| | Rare earth element compound composition (wt %) | | | | |
|---|---|---|---|---|---|
| | Dy | Tb | Fe | H | Nd |
| Example 7 | 30.0 | — | 40.0 | — | 30.0 |
| Example 8 | 94.1 | — | 4.9 | 1.0 | — |
| Example 9 | 87.3 | — | 11.9 | 0.8 | — |
| Example 10 | 79.5 | — | 19.9 | 0.6 | — |
| Example 11 | 59.8 | — | 39.9 | 0.3 | — |
| Example 12 | 45.0 | — | 54.9 | 0.1 | — |
| Example 13 | 33.9 | — | 66.0 | 0.1 | — |
| Example 14 | 29.9 | — | 40.0 | 0.3 | 29.9 |
| Example 15 | — | 88.0 | 12.0 | — | — |
| Example 16 | — | 80.0 | 20.0 | — | — |
| Comp. Ex. 1 | | | $DyF_3$ | | |

Comparative Examples 3-14

Rare earth magnets were produced in the same manner as Example 1, except that rare earth element compounds having the compositions shown in Table 2 were used instead of DyFe.

TABLE 2

| | Rare earth element compound composition (wt %) | | | | | | |
|---|---|---|---|---|---|---|---|
| | Rare earth element | | | | | | |
| | Ho | Er | Nd | Pr | Fe | Mo | B |
| Comp. Ex. 3 | 70.0 | — | — | — | 30.0 | — | — |
| Comp. Ex. 4 | — | 70.0 | — | — | 30.0 | — | — |
| Comp. Ex. 5 | — | — | 70.0 | — | 30.0 | — | — |
| Comp. Ex. 6 | — | — | — | 70.0 | 30.0 | — | — |
| Comp. Ex. 7 | 70.0 | — | — | — | 29.8 | 0.2 | — |
| Comp. Ex. 8 | — | 70.0 | — | — | 29.8 | 0.2 | — |
| Comp. Ex. 9 | — | — | 70.0 | — | 29.8 | 0.2 | — |
| Comp. Ex. 10 | — | — | — | 70.0 | 29.8 | 0.2 | — |
| Comp. Ex. 11 | 70.0 | — | — | — | 28.8 | 0.2 | 1.0 |
| Comp. Ex. 12 | — | 70.0 | — | — | 28.8 | 0.2 | 1.0 |
| Comp. Ex. 13 | — | — | 70.0 | — | 28.8 | 0.2 | 1.0 |
| Comp. Ex. 14 | — | — | — | 70.0 | 28.8 | 0.2 | 1.0 |

[Evaluation of Physical Properties]

(Measurement of Heavy Rare Earth Compound Coating Amount on Rare Earth Magnet Sintered Compact)

First, the coating amount of the rare earth magnet sintered compact was evaluated in terms of the difference according to the type of heavy rare earth compound adhered to the sintered compact. Specifically, the weight (A) before dipping the sintered compact in the Dy compound slurry and the weight (B) after dipping in the slurry and drying were measured during production of the rare earth magnet, and the coating amount of the heavy rare earth compound on the sintered compact was calculated by the following formula (1).

$$\text{Coating amount(wt \%)}=(B-A)/A\times 100 \quad (1)$$

(Calculation of Dy Component Coating Amount (Dy Content))

The Dy weight ratio of the heavy rare earth compound was multiplied by the coating amount to calculate the Dy wt % (Dy content) coated on the substrate. The results are shown in Table 3.

(Calculation of Rare Earth Component Coating Amount (Rare Earth Content))

The weight ratio of the rare earth component in the rare earth compound was multiplied by the coating amount to calculate the rare earth wt % (rare earth content) coated on the substrate. The results are shown in Table 4.

(Evaluation of Magnetic Properties)

A BH tracer was used to measure the magnetic properties of measuring samples obtained using the rare earth magnets of the examples and comparative examples. The residual flux density (Br) and coercive force (HcJ) of each measuring sample were determined based on the results.

TABLE 3

| | Coating | Dy or Tb | Treatment temperature 900° C. | | Treatment temperature 1000° C. | |
|---|---|---|---|---|---|---|
| | amount (wt %) | content (wt %) | Br (kG) | HcJ (kOe) | Br (kG) | HcJ (kOe) |
| Example 1 | 0.75 | 0.713 | 13.44 | 26.1 | 13.42 | 26.3 |
| Example 2 | 0.80 | 0.704 | 13.46 | 26.3 | 13.44 | 26.3 |
| Example 3 | 0.90 | 0.720 | 13.44 | 26.2 | 13.42 | 26.3 |
| Example 4 | 1.15 | 0.690 | 13.42 | 26.0 | 13.40 | 26.3 |
| Example 5 | 1.13 | 0.509 | 13.43 | 23.8 | 13.40 | 24.6 |
| Example 6 | 1.10 | 0.374 | 13.43 | 23.2 | 13.41 | 24.0 |
| Example 7 | 1.13 | 0.339 | 13.39 | 23.9 | 13.38 | 24.0 |
| Example 8 | 0.72 | 0.678 | 13.44 | 25.8 | 13.42 | 26.1 |
| Example 9 | 0.78 | 0.681 | 13.44 | 26.0 | 13.42 | 26.1 |
| Example 10 | 0.85 | 0.676 | 13.44 | 25.7 | 13.41 | 26.0 |
| Example 11 | 1.10 | 0.658 | 13.41 | 25.6 | 13.39 | 25.8 |
| Example 12 | 1.04 | 0.468 | 13.42 | 23.4 | 13.39 | 24.3 |
| Example 13 | 1.01 | 0.342 | 13.41 | 22.9 | 13.39 | 23.7 |
| Example 14 | 1.10 | 0.329 | 13.38 | 23.5 | 13.36 | 23.8 |
| Example 15 | 0.70 | 0.616 | 13.46 | 29.5 | 13.44 | 29.6 |
| Example 16 | 0.77 | 0.616 | 13.44 | 29.2 | 13.42 | 29.7 |
| Comp. Ex. 1 | 0.50 | 0.370 | 13.42 | 23.0 | 13.40 | 23.8 |
| Comp. Ex. 2 | 0 | 0 | 13.56 | 21.6 | — | — |

TABLE 4

| | Coating | Rare earth element | Treatment temperature 900° C. | | Treatment temperature 1000° C. | |
|---|---|---|---|---|---|---|
| | amount (wt %) | content (wt %) | Br (kG) | HcJ (kOe) | Br (kG) | HcJ (kOe) |
| Comp. Ex. 3 | 0.82 | 0.574 | 13.50 | 22.4 | 13.48 | 22.6 |
| Comp. Ex. 4 | 0.80 | 0.560 | 13.55 | 21.0 | 13.55 | 21.0 |
| Comp. Ex. 5 | 0.90 | 0.630 | 13.54 | 21.7 | 13.54 | 21.8 |
| Comp. Ex. 6 | 0.85 | 0.595 | 13.50 | 22.6 | 13.49 | 22.9 |
| Comp. Ex. 7 | 0.80 | 0.560 | 13.49 | 22.4 | 13.48 | 22.5 |
| Comp. Ex. 8 | 0.82 | 0.574 | 13.54 | 21.0 | 13.54 | 21.1 |
| Comp. Ex. 9 | 0.87 | 0.609 | 13.53 | 21.8 | 13.53 | 21.9 |
| Comp. Ex. 10 | 0.85 | 0.595 | 13.50 | 22.5 | 13.48 | 22.8 |
| Comp. Ex. 11 | 0.84 | 0.588 | 13.47 | 22.2 | 13.45 | 22.7 |
| Comp. Ex. 12 | 0.84 | 0.588 | 13.53 | 20.9 | 13.53 | 21.0 |

TABLE 4-continued

| | Coating | Rare earth element | Treatment temperature 900° C. | | Treatment temperature 1000° C. | |
|---|---|---|---|---|---|---|
| | amount (wt %) | content (wt %) | Br (kG) | HcJ (kOe) | Br (kG) | HcJ (kOe) |
| Comp. Ex. 13 | 0.91 | 0.637 | 13.53 | 21.7 | 13.53 | 21.8 |
| Comp. Ex. 14 | 0.86 | 0.602 | 13.49 | 22.4 | 13.47 | 22.9 |

Table 3 shows that Dy iron compounds adhered more readily than $DyF_3$ to the rare earth magnet sintered compacts, and therefore Dy iron compounds, having greater Dy contents by weight than $DyF_3$, are more advantageous for adhesion of Dy element itself onto sintered compacts.

Adequate Br and HcJ values were also confirmed with the rare earth magnets of Examples 1-14 which employed Dy iron compounds as the rare earth compounds adhered onto the sintered compacts. Likewise, adequate Br and HcJ values were confirmed with the rare earth magnets of Examples 15 and 16 which employed Tb iron compounds as the rare earth compounds adhered onto the sintered compacts. In addition, the rare earth magnets of Examples 1-16 not only had larger HcJ values, but even with heat treatment at 900° C. the HcJ values were equivalent to heat treatment at 1000° C.

On the other hand, as shown in Table 4, the rare earth magnets of Comparative Examples 3-14 demonstrated that a sufficiently high HcJ value is not obtained if the rare earth compound adhered onto the sintered compact does not contain Dy or Tb.

This confirmed that using a Dy or Tb iron compound as the heavy rare earth compound adhered to the sintered compact can maintain sufficient Br while also increasing HcJ, even at relatively low heat treatment temperatures.

What is claimed is:

1. A process for producing a magnet, comprising a first step in which a heavy rare earth compound containing Dy or Tb as a heavy rare earth element is adhered onto a sintered compact of a rare earth magnet, a second step in which the heavy rare earth compound-adhered sintered compact is subjected to heat treatment, wherein the heavy rare earth compound is an iron compound of said Dy or an iron compound of said Tb, wherein in the first step, a slurry of the heavy rare earth compound dispersed in a solvent is coated onto the sintered compact, and wherein the heavy rare earth compound is DyFe, TbFe, DyFeH, TbFeH, DyNdFe or DyNdFeH, and a Dy or Tb content in the heavy rare earth compound is from 60 wt % to 95 wt %.

2. The process for producing a magnet according to claim 1, wherein the mean particle size of the heavy rare earth compound is 100 nm-50 μm.

* * * * *